US006522071B1

(12) United States Patent
Park et al.

(10) Patent No.: US 6,522,071 B1
(45) Date of Patent: Feb. 18, 2003

(54) PLASMA DISPLAY PANEL

(75) Inventors: Hun Gun Park, Kyongsangbuk-do (KR); Kyung Hun Jung, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/572,780

(22) Filed: May 17, 2000

(30) Foreign Application Priority Data

May 18, 1999 (KR) ..... 99-17800

(51) Int. Cl.[7] ..... H01J 17/49; H01J 11/02

(52) U.S. Cl. ..... 313/582; 313/583; 313/584; 313/585; 313/586

(58) Field of Search ..... 313/582, 583, 313/584–586

(56) References Cited

U.S. PATENT DOCUMENTS 4,010,395 A * 3/1977 Holz ..... 313/585
6,084,349 A * 7/2000 Ueoka et al. ..... 313/112
6,118,214 A * 9/2000 Marcotte ..... 313/582
6,147,452 A * 11/2000 Kunhardt et al. ..... 313/582

FOREIGN PATENT DOCUMENTS

EP 860849 A2 * 8/1998 ..... H01J/17/49
JP 2001015041 A * 1/2001 ..... H01J/11/02

* cited by examiner

*Primary Examiner*—Nimeshkumar D. Patel
*Assistant Examiner*—Sikha Roy
(74) *Attorney, Agent, or Firm*—Fleshner & Kim, LLP

(57) ABSTRACT

Plasma display panel including a plurality of pairs of sustain electrodes on one of two bonded substrates, each having a transparent electrode and a metal electrode for sustaining an initial discharge between the electrodes for a preset time period, wherein the transparent electrode has a plurality of pass through holes, thereby improving a discharge efficiency between electrodes because an increase of a discharge current and a reduction of transmittivity is prevented even if a width of the transparent electrode is increased for improving an overall luminance of the plasma display panel.

35 Claims, 9 Drawing Sheets

PLASMA DISPLAY PANEL

BACKGROUND OF THE INVENTION

1. Field of the Invention

The present invention relates to a plasma display panel in which a discharge of gas between glass substrates are utilized for displaying an image, and more particularly, to a discharge electrode in a plasma display panel.

2. Background of the Related Art

Having all the advantages of the clear picture and the variety of screen sizes of the cathode ray tubes, and of the light and thin liquid display panel, the plasma display panel is considered as the next generation display. In general, the plasma display panel is light as it weighs approx. ⅓ of the cathode ray tube of the same screen size, and thin as it has a thickness below 10 cm even for a large sized panel of 40 to 60". Moreover, though the cathode ray tube or the liquid crystal display has a limitation on a size in displaying a digital data picture and a full motion picture on the same time, the plasma display panel has no such a problem. And, while the cathode ray tube is influenced from a magnetic force, the plasma display panel is not influenced from the magnetic force, permitting to provide a stable picture to the watchers. And, since the pixels are controlled in a digital fashion, with no distortion of images at corners of the screen, the plasma display panel can provide a picture quality better than the cathode ray tube. The plasma display panels, using a gaseous discharge inside of the panel in displaying an image, are used as TV receivers, monitors, indoor and outdoor signboards and the like having large sized displays, particularly, directing to displays of the HDTV(High Definition Television) age, since the plasma display panel has a simple fabrication process as provision of active element to every cell is not required, is easy to provide a large sized screen, and has a fast response speed. The plasma display panel is provided with two glass substrates sealed together having electrodes coated thereon perpendicular, and opposite to each other, and gas filled in a space between the two glass substrates. There are pixels at portions the electrodes are crossed. In operation, a voltage higher than 100 volts are provided between the perpendicular electrodes, to cause a glow discharge of the gas, for displaying an image by using a light provided in the discharge. There are a two electrode type, a triode type, and a four electrode type in the plasma display panels with respect to a number of electrodes each cell has, wherein the two electrode type has two electrodes to which addressing and sustain voltages are provided on the same time, and the triode type, called as a surface discharge type, is adapted to be switched or sustained by a voltage provided to a electrode at a side of a discharge cell.

A related art triode surface discharge type plasma display panel will be explained with reference to the attached drawings. FIG. 1 illustrates a perspective view of a disassembled upper and lower substrates of the related art plasma display panel, FIG. 2 illustrates a section of a related art plasma display panel, FIG. 3 illustrates a plan view of scan electrodes and sustain electrodes of a related art plasma display panel, FIG. 4 illustrates a section across line I–I' in FIG. 3, FIG. 5 illustrates wiring of scan electrodes and sustain electrodes of a related art plasma display panel, FIGS. 6A~6D illustrate a discharge principle of a related art plasma display panel, and FIG. 7 illustrates an electric field formed between a pair of discharge electrodes and spreading of a discharge.

Referring to FIG. 1 and 2, the related art triode surface discharge type plasma display panel has an upper substrate

10 and a lower substrate 20 bonded and sealed together to face each other. On the upper substrate 10, there are scan electrodes 16 and 16' and sustain electrodes 17 and 17' parallel to each other, a dielectric layer 11 coated on the scan electrodes 16 and 16' and the sustain electrodes 17 and 17', and a protection film 12. On the lower substrate 20, there are address electrodes 22, a dielectric film 21 on an entire surface of the substrate including the address electrodes 22, partition walls 23 on the dielectric film 21 between the address electrodes 22, and a fluorescent material 24 on surfaces of the partition wall 23 and the dielectric film 21 in each discharge cell. The upper substrate 10 and the lower substrate 20 are bonded together by frit glass, and a space between the upper and lower substrates 10 and 20 is filled with a mixture of inert gas, such as helium He and xenon Xe, to a pressure in a range of 400~500 Torr, to form a discharge space. In general, the inert gas filled in the discharge space of a D.C. plasma display panel is a mixture of helium and xenon (He—Xe), and the inert gas filled in the discharge space of an A.C. plasma display panel is a mixture of neon and xenon (Ne—Xe).

Referring to FIGS. 3 and 4, of the scan electrodes 16 and 16' and the sustain electrodes 17 and 17', the electrodes 16 and 17 are formed of transparent material, and the electrodes 16' and 17' are formed of a metal for enhancing light transmission of each discharge cell. The metal scan electrode and sustain electrode 16' and 17' are provided with a discharge voltage from a driving IC fitted outside of the panel, and the transparent scan electrode and sustain electrode 16 and 17 are provided with the discharge voltage to the metal electrodes 16' and 17', to cause a discharge between adjacent transparent electrodes 16 and 17. The transparent electrode 16 or 17 is formed of indium oxide or tin oxide of a total width of approx. 300 $\mu$m, and the metal electrode 16' or 17' is a thin film consisting of three layers of chrome-copper-chrome. A width of the bus electrode 16' or 17' line has approx. ⅓ of a width of the transparent electrode 16 or 17 line.

FIG. 5 illustrates wiring of the scan electrodes Sm−1, Sm, Sm+1, - - - , Sn−1, Sn, Sn+1 and the sustain electrodes Cm−1, Cm, Cm+1, - - - , Cn−1, Cn, Cn+1 arranged on the upper substrate, wherein, while the scan electrodes are insulated from each other, all the sustain electrodes are connected in parallel. In FIG. 5, the section enclosed by the dashed line represents an effective surface an image is displayed thereon, and the other section represents a non-effective surface no image is displayed thereon. The scan electrodes on the non-effective surface are in general called dummy electrodes 26, a number of which are not particularly limited.

The operation of the aforementioned triode surface discharge type AC type plasma display panel will be explained with reference to FIGS. 6A~6D.

Referring to FIG. 6A, when a driving voltage is applied between the address electrode and the scan electrode, an opposed discharge is occurred between the address electrode and the scan electrode. The opposed discharge excites the inert gas in the discharge cell, so that a portion of the inert gas is divided to electrons, ions and excited species. As shown in FIG. 6B, a portion of the ions collides onto a surface of the protection film, which causes emission of secondary electrons from the surface of the protection film. The secondary electrons collide with the gas in a plasma state, to spread the discharge. As shown in FIG. 6C, when the opposed discharge between the address electrode and the scan electrode ends, wall charges with opposite polarities are generated on surfaces of the protection film over the sustain electrode and the scan electrode, respectively. And, as shown in FIG. 6D, when the driving voltage provided to the address electrode is cut off during the wall charges with opposite polarities build up at the scan electrode and the sustain electrode continuously, there is a surface discharge occurred in a discharge region on a surface of the dielectric layer and the protection layer due to a potential difference between the scan electrode and the sustain electrode. These opposed discharge and the surface discharge cause electrons in the discharge cell to collide onto the inert gas in the discharge cell, to generate an UV ray of 147 nm wavelength in the discharge cell as the inert gas is excited. The UV ray collide onto the fluorescent material coated on the address electrode and the partition wall, to excite the fluorescent material, which generates a visible light, that permits to form a picture on the screen.

However, the related art plasma display panel has the following problems.

As described, it can be known that a sustain discharge between one pair of the sustain electrodes in each cell sustains light emission of an initially lighted cell. Therefore, it is required to increase a width of the transparent electrode 16 or 17 to increase an amount of discharge between the electrodes for enhancing luminance in lighting the cell, which, however, increases a discharge capacitance in proportion to an increase of a transparent electrode area, that drops a luminous efficiency and increases a power consumption. And, even if the transparent electrode has a comparatively high transmittivity, since the transparent electrode has certain extent of transmission reduction factor, to drop the transmittivity relative to the increase of the width of the transparent electrode, the luminance drops, on the contrary.

SUMMARY OF THE INVENTION

Accordingly, the present invention is directed to a plasma display panel that substantially obviates one or more of the problems due to limitations and disadvantages of the related art.

An object of the present invention is to provide a plasma display panel which can minimize an increase of power consumption and drop of transmittivity while a width of a transparent electrode is increased for increasing an amount of discharge.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the plasma display panel includes a plurality of pairs of sustain electrodes on one of two bonded substrates, each having a transparent electrode and a metal electrode for sustaining an initial discharge between the electrodes for a preset time period, wherein the transparent electrode has a plurality of pass through holes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

FIRST EMBODIMENT

Figure 1:
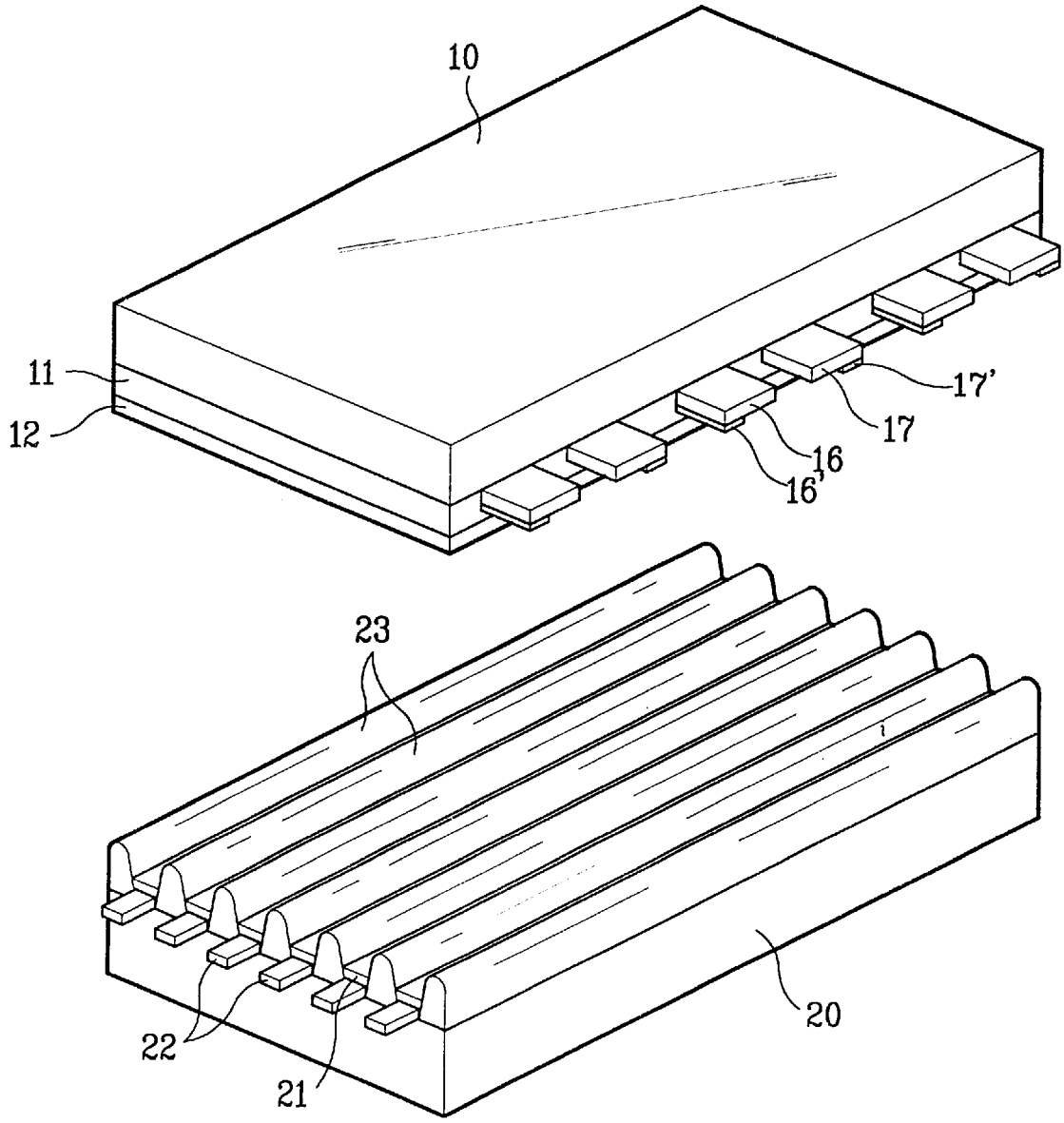
FIG.1 Conventional Art
FIG. 1 illustrates a perspective view of a disassembled upper and lower substrates of the related art plasma display panel.
Figure 2:
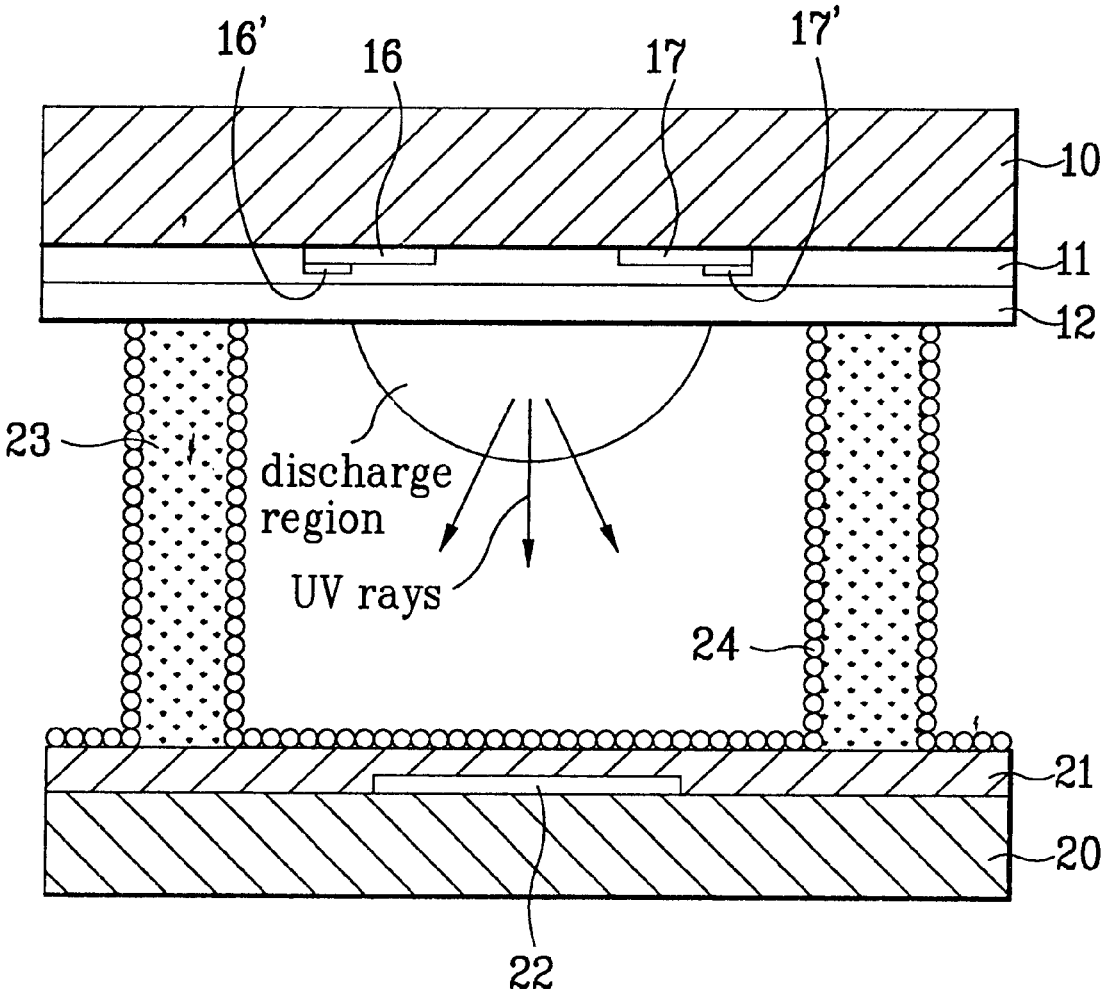
FIG.2 Conventional Art
FIG. 2 illustrates a section of a related art plasma display panel.
Figure 3:
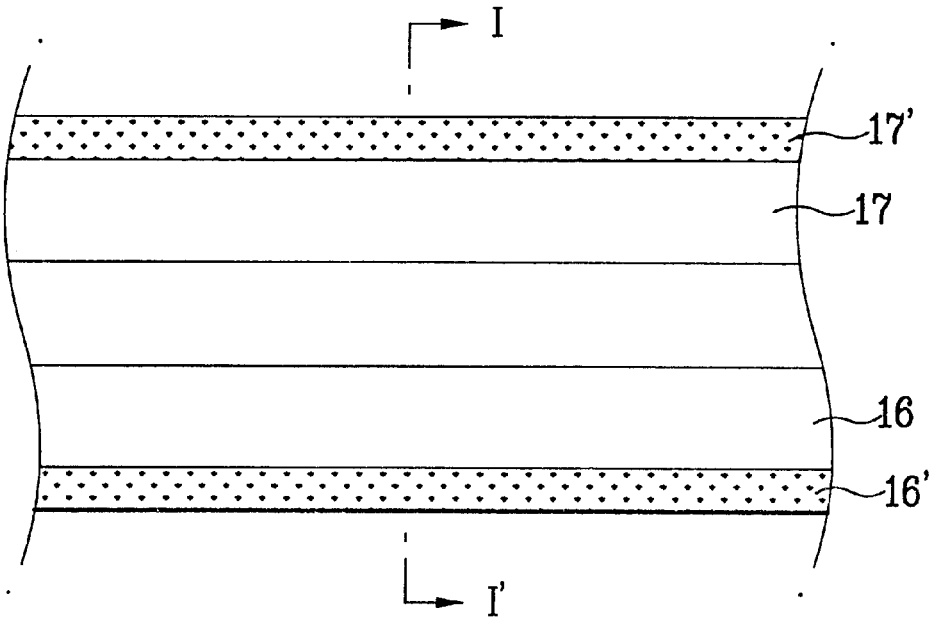
FIG.3 Conventional Art
FIG. 3 illustrates a plan view of scan electrodes and sustain electrodes of a related art plasma display panel.
Figure 4:
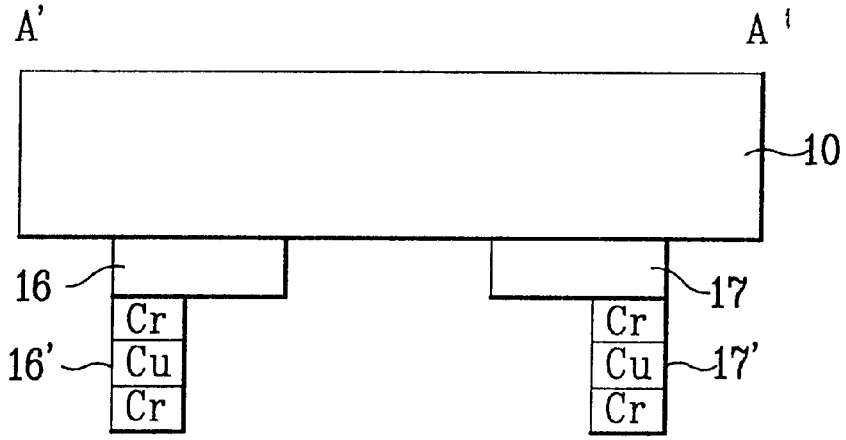
FIG.4 Conventional Art
FIG. 4 illustrates a section across line I–I' in FIG. 3.
Figure 5:
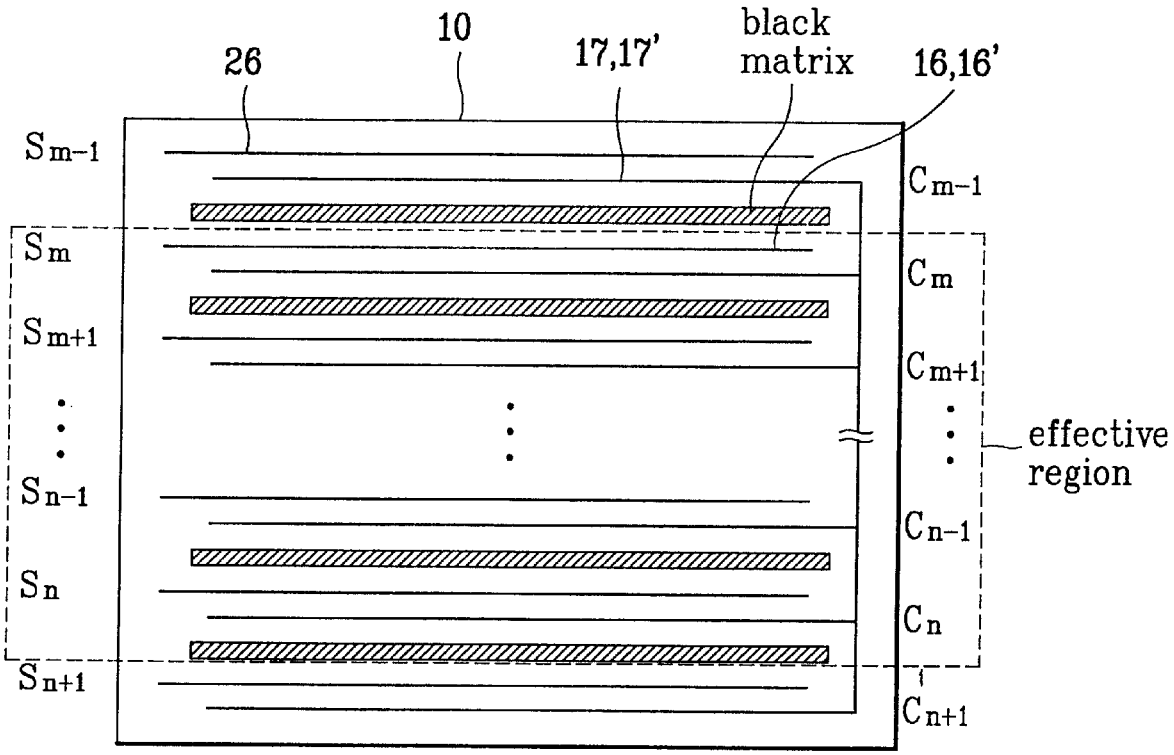
FIG.5 Conventional Art
FIG. 5 illustrates wiring of scan electrodes and sustain electrodes of a related art plasma display panel.
Figure 6A:
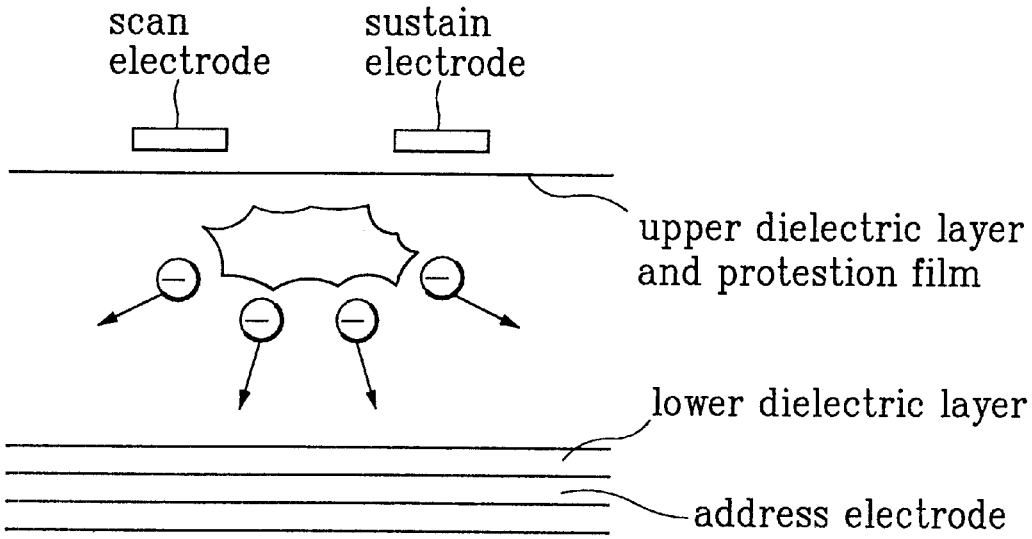
FIGS. 6A~6D illustrate a discharge principle of a related art plasma display panel.
Figure 6B:
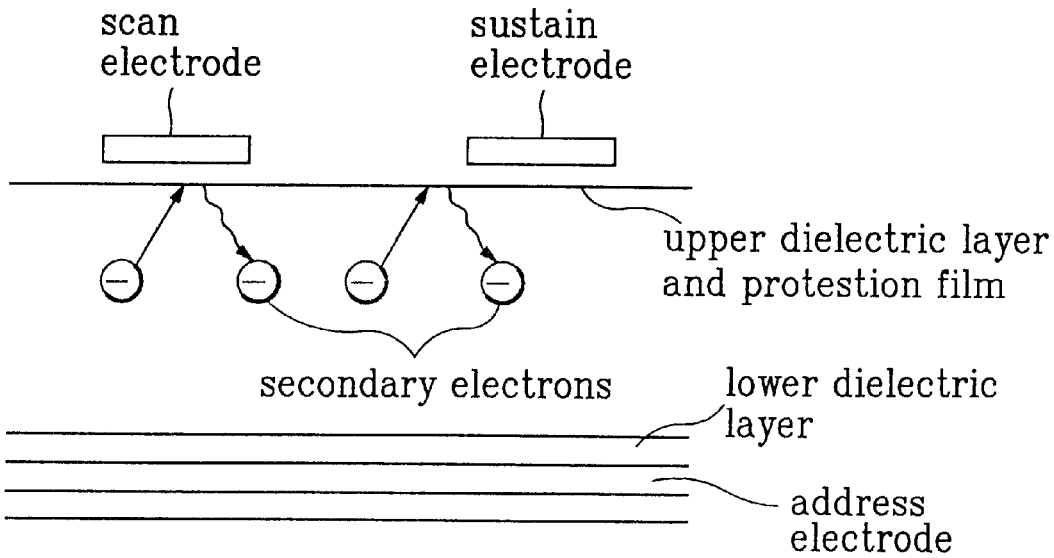
Figure 6C:
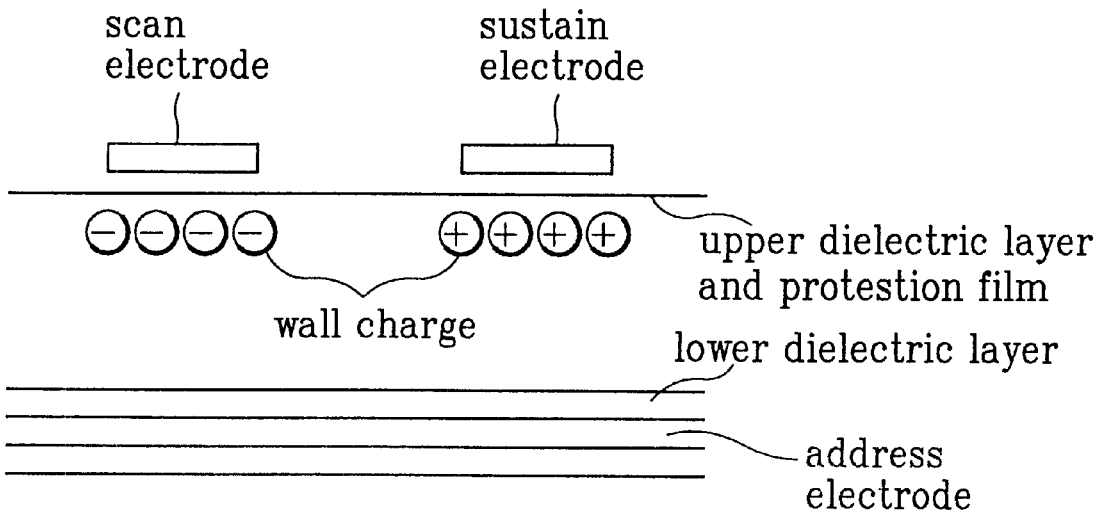
Figure 6D:
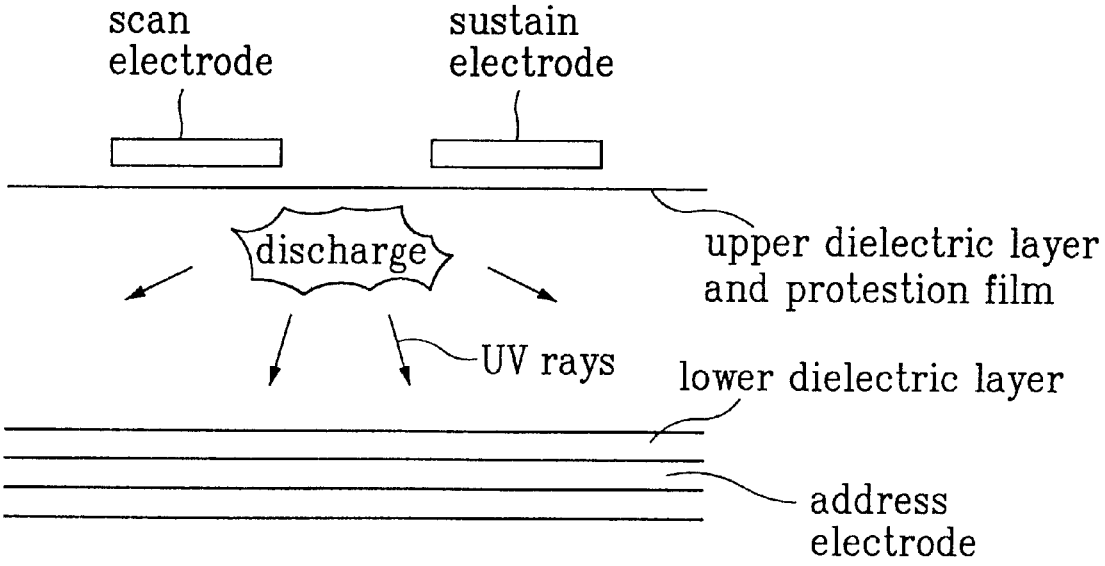
Figure 7:
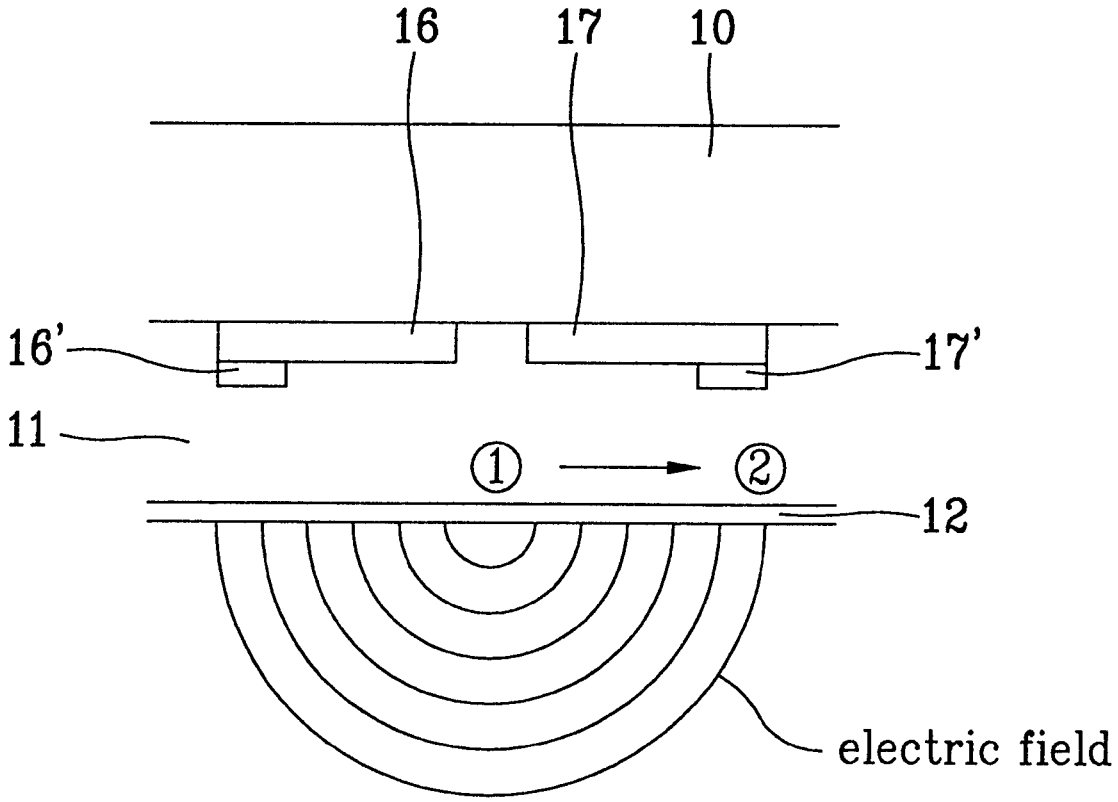
FIG. 7 illustrates an electric field formed between a pair of discharge electrodes and spreading of a discharge.
Figure 8:
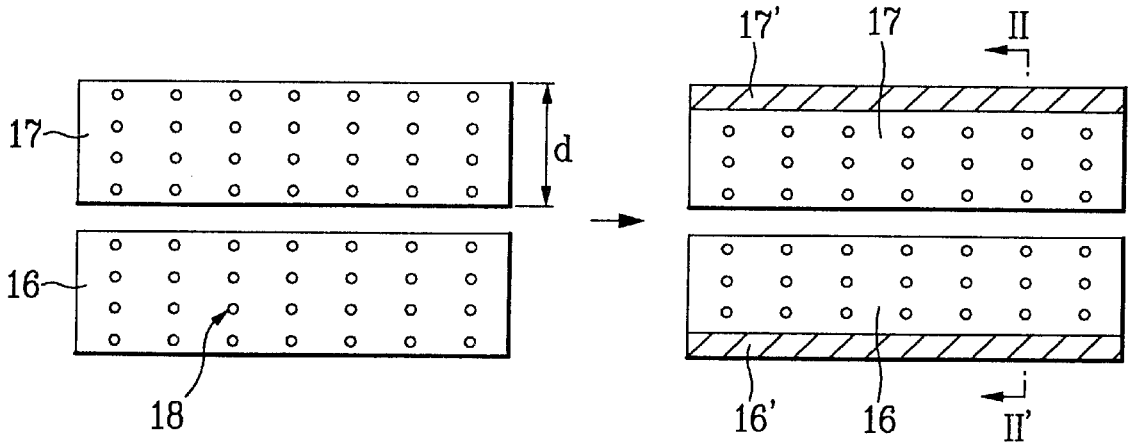
FIG. 8 illustrates a plan view of electrodes of a plasma display panel in accordance with a first preferred embodiment of the present invention.
Figure 9:
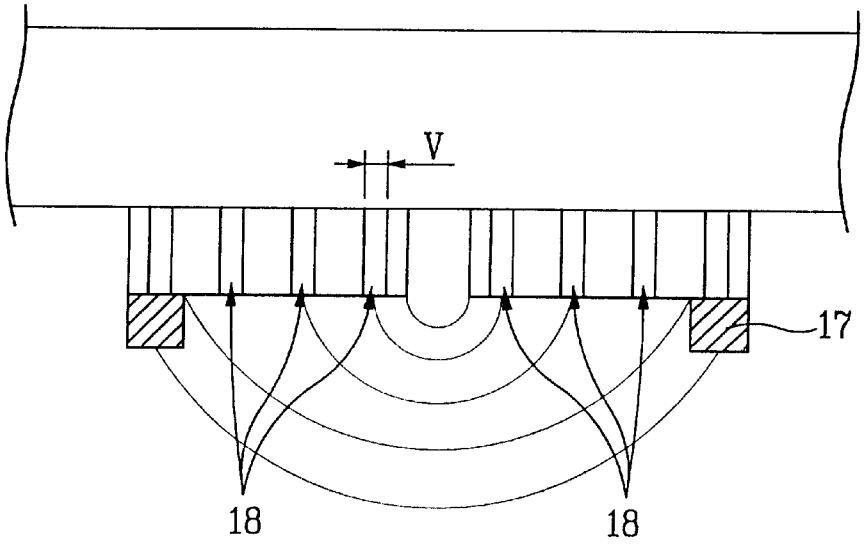
FIG. 9 illustrates a section across line I–I'.

FIG. 8 illustrates a plan view of electrodes of a plasma display panel in accordance with a first preferred embodiment of the present invention, and FIG. 9 illustrates a section across line I–I'.

On an upper glass substrate of the plasma display panel in accordance with a first preferred embodiment of the present invention, there are scan electrodes 16 and 16' and sustain electrodes 17 and 17' formed thereon. Of the scan electrodes 16 and 16' and the sustain electrodes 17 and 17', the electrodes 16 and 17 are transparent each with a width wider than the same of the related art, and the electrodes 16' and 17' are of a metal each with perforation of circular pass through holes 18 formed in row and column directions. Particularly, when the transparent electrode 16 or 17 has the width greater than 300 $\mu$m, the pass through hole 18 has a diameter of approx. 30~50 $\mu$m. In the foregoing structure of the scan electrodes 16 and 16' and the sustain electrodes 17 and 17', even if the widths of the transparent electrodes 16 and 17 are increased for increasing an amounts of discharge between electrodes, there is no increase of a discharge capacitance in comparison to the related art because an entire area of the transparent electrodes 16 and 17 are offset by the pass through holes 18. That is, because the pass through holes 18 reduce the area of the transparent electrodes 16 and 17, while sizes of the pass through holes 18 are formed small not to affect discharge spreading, the discharge amount of the scan electrodes 16 and 16' and the sustain electrodes 17 and 17' can be increased as much as the increased transparent electrodes 16 and 17, at the end. However, the pass through hole 18 with a too small radius can not influence to a reduction of an area of the transparent electrodes 16 and 17, and, opposite to this, the pass through hole 18 with a too large radius impedes the spreading of the discharge path, with drop of a discharge efficiency. And, because the visible light from the fluorescent material caused by the discharge between the scan electrodes 16 and 16' and the sustain electrodes 17 and 17' forms an image as the light passes through the pass through holes, there is no reduction of a transmittivity of the transparent electrodes 16 and 17 caused by the increased width of the electrodes. Thus, the plasma display panel in accordance with a first preferred embodiment of the present invention can improve a luminance of a plasma display panel and prevent an increase of power consumption provide for discharge between electrodes.

SECOND EMBODIMENT

Figure 10:
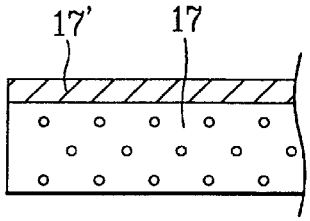
FIG. 10 illustrates a plan view of electrodes of a plasma display panel in accordance with a second preferred embodiment of the present invention.

FIG. 10 illustrates a plan view of electrodes of a plasma display panel in accordance with a second preferred embodiment of the present invention. Though the plasma display panel in accordance with a second preferred embodiment of the present invention includes scan electrodes 16 and 16' and sustain electrodes 17 and 17' identical to the first embodiment, pass through holes 18 are formed in a diagonal direction. That is, the circular pass through holes 18 are arrange in the diagonal direction, which has the same effect with the first embodiment.

THIRD EMBODIMENT

Figure 11:
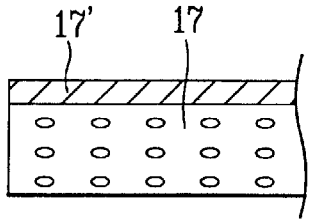
FIG. 11 illustrates a plan view of electrodes of a plasma display panel in accordance with a third preferred embodiment of the present invention.

FIG. 11 illustrates a plan view of electrodes of a plasma display panel in accordance with a third preferred embodiment of the present invention. Though the plasma display panel in accordance with a third preferred embodiment of the present invention includes scan electrodes 16 and 16' and sustain electrodes 17 and 17' identical to the first embodiment, pass through holes 18 are, not circular, but oval. That is, the oval pass through holes 18 are arrange in vertical and horizontal directions, which has the same effect with the first embodiment.

FOURTH EMBODIMENT

Figure 12:
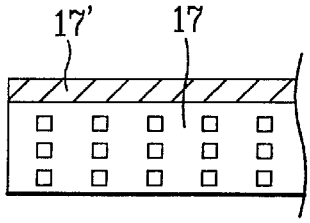
FIG. 12 illustrates a plan view of electrodes of a plasma display panel in accordance with a fourth preferred embodiment of the present invention.

FIG. 12 illustrates a plan view of electrodes of a plasma display panel in accordance with a fourth preferred embodiment of the present invention. Though the plasma display panel in accordance with a fourth preferred embodiment of the present invention includes scan electrodes 16 and 16' and sustain electrodes 17 and 17' identical to the first embodiment, pass through holes 18 are, not circular, but square arranged in a vertical and a horizontal directions. That is, the square pass through holes 18 are arrange in vertical and horizontal directions. Of course, the square pass through holes 18 may be arrange in a diagonal direction. The fourth embodiment has the same effect with the first embodiment.

FIFTH EMBODIMENT

Figure 13:
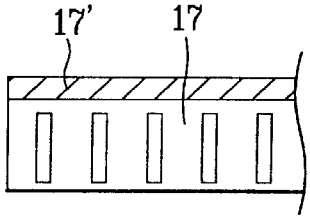
FIG. 13 illustrates a plan view of electrodes of a plasma display panel in accordance with a fifth preferred embodiment of the present invention; and, FIG. 14 illustrates a plan view of electrodes of a plasma display panel in accordance with a sixth preferred embodiment of the present invention.

FIG. 13 illustrates a plan view of electrodes of a plasma display panel in accordance with a fifth preferred embodiment of the present invention. Though the plasma display panel in accordance with a fifth preferred embodiment of the present invention includes scan electrodes 16 and 16' and sustain electrodes 17 and 17' identical to the first embodiment, pass through holes 18 are, not circular, but rectangular in a horizontal direction, which has the same effect with the first embodiment.

SIXTH EMBODIMENT

Figure 14:
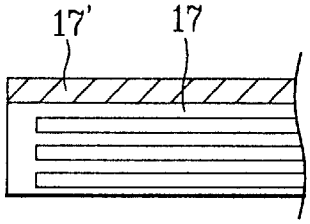

FIG. 14 illustrates a plan view of electrodes of a plasma display panel in accordance with a sixth preferred embodiment of the present invention. Though the plasma display panel in accordance with a sixth preferred embodiment of the present invention includes scan electrodes 16 and 16' and sustain electrodes 17 and 17' identical to the first embodiment, pass through holes 18 are, not circular, but rectangular in a vertical direction, which has the same effect with the first embodiment.

As has been explained, the plasma display panel of the present invention has the following advantage.

First, the perforation of the transparent electrodes among the scan electrodes and the sustain electrodes can improve a discharge efficiency between electrodes because an increase of a discharge current and a reduction of transmittivity is prevented even if a width of the transparent electrode is increased for improving an overall luminance of the plasma display panel.

It will be apparent to those skilled in the art that various modifications and variations can be made in the plasma display panel of the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a plurality of pairs of sustain electrodes on one of two bonded substrates, each having a transparent electrode and a metal electrode for sustaining an initial discharge between the electrodes for a preset time period, wherein the transparent electrode has a plurality of pass through holes arranged in a plurality of rows and columns.

2. The plasma display panel as claimed in claim 1, wherein the pass through holes are circular.

3. The plasma display panel as claimed in claim 1, wherein the pass through holes are oval.

4. The plasma display panel as claimed in claim 1, wherein the pass through holes are square.

5. The plasma display panel as claimed in claim 1, wherein the pass through holes are arranged in vertical and horizontal directions.

6. The plasma display panel as claimed in claim 1, wherein the pass through holes are arranged in a diagonal direction.

7. The plasma display panel as claimed in claim 1, wherein the pass through holes are rectangular and are arranged in a short axis direction of the rectangle.

8. The plasma display panel as claimed in claim 1, wherein the pass through holes are circular with a radius of 30 $\mu$m~50 $\mu$m, when the transparent electrode has a width of 300 $\mu$m.

9. A plasma display panel, comprising:

a substrate;

a scan electrode on the substrate having a stack of a transparent electrode and a metal electrode, wherein a plurality of pass through holes are formed in the transparent electrode and arranged in a plurality of rows and/or columns; and a sustain electrode on the substrate on one side of the scan electrode having a stack of a transparent electrode and a metal electrode, wherein a plurality of pass through holes are formed in the transparent electrode and arranged in a plurality of rows and columns.

10. The plasma display panel as claimed in claim 9, wherein the pass through holes are circular.

11. The plasma display panel as claimed in claim 9, wherein the pass through holes are oval.

12. The plasma display panel as claimed in claim 9, wherein the pass through holes are square.

13. The plasma display panel as claimed in claim 9, wherein the pass through holes are arranged in vertical and horizontal directions.

14. The plasma display panel as claimed in claim 9, wherein the pass through holes are arranged in a diagonal direction.

15. The plasma display panel as claimed in claim 9, wherein the pass through holes are rectangular and are arranged in a short axis direction of the rectangle.

16. The plasma display panel as claimed in claim 9, wherein the pass through holes are circular with a radius of 30 $\mu$m~50 $\mu$m, when the transparent electrode has a width of 300 $\mu$m.

17. The plasma display panel as claimed in claim 1, wherein the plurality of rows and columns extend over substantially the entire surface area of the transparent electrode.

18. The plasma display panel as claimed in claim 9, wherein the plurality of rows and columns extend over substantially the entire surface area of the transparent electrode.

19. A plasma display panel, comprising:

a plurality of pairs of sustain electrodes on one of two bonded substrates, each having a transparent electrode and a metal electrode for sustaining an initial discharge between the electrodes for a preset time period, wherein the transparent electrode has a plurality of pass through holes configured to allow light to pass therethrough to increase transmissivity, wherein the plurality of pass through holes are distributed over substantially the entire surface area of the transparent electrode.

20. The plasma display panel in claim 19, wherein the plurality of pass through holes are arranged in a plurality of rows and columns.

21. The plasma display panel as claimed in claim 19, wherein the pass through holes are circular.

22. The plasma display panel as claimed in claim 19, wherein the pass through holes are oval.

23. The plasma display panel as claimed in claim 19, wherein the pass through holes are square.

24. The plasma display panel as claimed in claim 19, wherein the pass through holes are arranged in a diagonal direction.

25. The plasma display panel as claimed in claim 19, wherein the pass through holes are rectangular and are arranged in a short axis direction of the rectangle.

26. The plasma display panel as claimed in claim 19, wherein one of the two bonded substrates comprises a non-light transmissive substrate, wherein the other of the two bonded substrates comprises a light transmissive substrate, the pair of sustain electrodes being bonded to the light transmissive substrate, and further comprising partition walls forming discharge cells.

27. A plasma display panel, comprising:

a substrate;

a scan electrode on the substrate having a stack of a transparent electrode and a metal electrode, wherein a plurality of pass through holes are formed in the transparent electrode and are distributed over substantially the entire surface area of the transparent electrode; and a sustain electrode on the substrate on one side of the scan electrode having a stack of a transparent electrode and a metal electrode, wherein a plurality of pass through holes are formed in the transparent electrode and are configured to allow light to pass therethrough to increase transmissivity.

28. The plasma display panel in claim 27, wherein the plurality of pass through holes are distributed over substantially the entire surface area of the transparent electrode.

29. The plasma display panel in claim 27, wherein the plurality of pass through holes are arranged in a plurality of rows and/or columns.

30. The plasma display panel as claimed in claim 27, wherein the pass through holes are circular.

31. The plasma display panel as claimed in claim 27, wherein the pass through holes are oval.

32. The plasma display panel as claimed in claim 27, wherein the pass through holes are square.

33. The plasma display panel as claimed in claim 27, wherein the pass through holes are arranged in a diagonal direction.

34. The plasma display panel as claimed in claim 27, wherein the pass through holes are rectangular and are arranged in a short axis direction of the rectangle.

35. The plasma display panel as claimed in claim 27, wherein the substrate comprises a light transmissive substrate, and the plasma display panel further comprises a non-light transmissive substrate disposed adjacent to the light transmissive substrate and partition walls forming discharge cells.

* * * * *